US006971808B2

(12) United States Patent
Dawson

(10) Patent No.: US 6,971,808 B2
(45) Date of Patent: Dec. 6, 2005

(54) CARD PRINTING DEVICES

(75) Inventor: Chris Dawson, West Sussex (GB)

(73) Assignee: NBS Technologies Limited, Surrey (GB)

( * ) Notice: Subject to any disclaimer, the term of this patent is extended or adjusted under 35 U.S.C. 154(b) by 0 days.

(21) Appl. No.: 10/680,785

(22) Filed: Oct. 8, 2003

(65) Prior Publication Data

US 2004/0114983 A1 Jun. 17, 2004

(30) Foreign Application Priority Data

Oct. 9, 2002 (GB) ..... 0223479

(51) Int. Cl.[7] ..... B41J 13/12; B41J 13/18

(52) U.S. Cl. ..... 400/521; 400/535; 400/536; 400/537; 400/624; 400/625; 271/145; 271/162

(58) Field of Search ..... 400/521, 535–537, 400/541, 624–625; 271/145, 157, 162, 35

(56) References Cited

U.S. PATENT DOCUMENTS 4,561,819 A * 12/1985 Wiernicki ..... 414/331.17
4,666,141 A * 5/1987 Labombarde ..... 271/35
5,588,643 A * 12/1996 Tagliaferri et al. ..... 271/35
6,050,563 A * 4/2000 Vedoy et al. ..... 271/10.07
6,270,072 B1 * 8/2001 Louie ..... 271/157
6,554,512 B2 * 4/2003 Heno et al. ..... 400/625
2002/0059880 A1 * 5/2002 Klinefelter et al. ..... 101/484
2003/0155419 A1 * 8/2003 Bretl et al. ..... 235/440
2003/0207744 A1 * 11/2003 Bretl ..... 493/375
2004/0084518 A1 * 5/2004 Bretl et al. ..... 235/375

FOREIGN PATENT DOCUMENTS

GB 2 178 409 A 2/1987

* cited by examiner

*Primary Examiner*—Andrew H. Hirshfeld
*Assistant Examiner*—Marissa Ferguson
(74) *Attorney, Agent, or Firm*—Breiner & Breiner, L.L.C.

(57) ABSTRACT

Card printing apparatus, for example, for printing identification cards, pass cards and the like generally comes with a relatively restricted size card input hopper. The number of cards that can be processed in a single operation is accordingly limited. The capacity for a single run of card printing can be materially increased without leading to card feed problems because of the increased pressure at the bottom of a stack of cards by arranging that at least part of the in-feed hopper is inclined away from the vertical. In order to maintain the footprint of the printer relatively small, the hopper preferably has two vertical sections and an intermediate inclined section.

4 Claims, 2 Drawing Sheets

33
4
30
31
32
2
1

33
31
35
1
2

4
38
1
2
31

4
1
2
31

CARD PRINTING DEVICES

FIELD OF THE INVENTION

This invention relates to card printing devices.

BACKGROUND TO THE INVENTION

In recent years, the use of small rectangular pieces of plastics for identification and validation of all sorts of types of financial and other transactions has become ubiquitous. From the early days of embossed so-called charge cards or credit cards, which were carried by a relatively small proportion of the population, such cards are now used across a very wide spectrum and for purposes other than validating financial transactions.

Although the items in question are universally referred to as "cards", generally speaking, they consist not of card, but of a plastics material. They may be composed of a single rectangular sheet of uniform such material, or they may have, for example, a sandwich or layered construction. In either case, there is a necessity for the card to carry certain common information, i.e. information which will be in common with other cards from the same issuer, as well as personalised information, for example the name of the card holder, account number or the like.

This small rectangular card format is particularly convenient for use as some form of identity card, pass card or the like. The card may be wholly plastic, or it may, for example, have contained in its structure an RFID tag or other reactive components. It may even contain an embedded microchip. Cards of this type are denoted "smart cards".

In order to guard against fraudulent transactions, it is often desired to have as part of the variable material on the card a picture of the user. Old methods of personalising, e.g. credit and charge cards such as embossing, while satisfactory within certain constraints, simply are not apt to reproduce a photograph or similar image.

In recent years, apparatus has been developed for applying to a blank card of the type described above personalised data, specifically by printing. Printing apparatus is known for personalising transaction cards of one sort and another, and these are particularly valuable for occasional use where relatively small numbers of cards are required. A typical example is the issuance of a student identity card, or a library borrower's card. In either case, details about the student or borrower may be entered into a computer, their image digitally captured using a simple digital data image capture device such as a webcam, and the data may then be simply fed to a computer controlled printing apparatus which produces an appropriate image on a pre-formed blank.

A problem arises in connection with such apparatus where the numbers of cards to be produced are insufficient to justify the expense of mass production apparatus, but too many for comfortable, simple, manual processing. In known apparatus available in commerce, computer controlled card printing devices are known which have an input hopper into which a set of blank cards is inserted and from which they are removed one by one, passed through an appropriate print station, and ejected into an output stack, chute or the like.

As noted above, cards are generally not made of card, but rather of plastics material. Many such materials have a tendency to "stick together", particularly in a stack of unprinted cards where there is not even the printing to assist separation of the cards one from another. Separation of the bottommost card of a stack may usually be achieved without too much difficulty so long as the stack is not too high. If it is, the pressure of the stack on the lowermost card renders it difficult to remove the card without the use of positively engaging card-shifting pusher members or the like; the usual frictional engagement with a rubbery drive wheel is insufficient to overcome the forces, both of friction and so-called 'stiction', which act on the bottom card. Thus, if a high card stack is desired, substantial outlay in terms of printer machine design and construction is needed in order to ensure that the bottommost card can be reliably fed into the printer. As well as additional mechanical outlay, the space taken up by the card feeding mechanism increases. Pre-treating the cards to reduce friction between them and the tendency to 'stick' also adds to the expense, and there is a particular difficulty in the sense that many coatings which might notionally be applied to such cards to make them slide over one another with greater ease would also make the card surface more difficult to print on, thus undermining the very process which the card blanks are to undergo.

GENERAL DESCRIPTION OF THE INVENTION

We have now found that simple card feeder mechanisms may be retained while enabling the automated printing of a stack of cards by providing that the apparatus has means for removing cards simultaneously from the base of a stack of such cards, and wherein the stack is, at least in part, inclined to the vertical. The degree of inclination is preferably at least 15°, and it may be as much as 45° or even more. In any event, the inclination of the stack seems to have the effect of reducing the direct downward pressure on the lowermost card in the stack, enabling that card to be more simply and more reliably separated from the card above it. The inclination of the stack may be achieved by suitable design of the input hopper.

Since card printing apparatus of the type referred to is generally fairly compactly designed, and accordingly is used in environments where there is not a great deal of room, e.g. on a desktop, it is highly desirable that the footprint of the apparatus is no larger than necessary. In order to achieve this, the input hopper, into which the stack of cards to be printed is placed, may extend generally vertically upwards, but have, preferably at or near its base, an inclined section.

The floor of the input hopper is usually substantially horizontal, though it may be slightly inclined from the horizontal, depending upon the precise engineering detail of the in-feed mechanism. We have found that if the dimensions of the in-feed hopper, in a plane parallel to the floor of the hopper, in at least one portion of the in-feed hopper, are such as to incline the cards successively as they travel down the hopper at an angle which differs from the angle of the floor and accordingly the angle of the lowermost card, the reliability of card separation and smooth sequential feeding of the cards into the printing portion of the machine is much enhanced, believed to be at least in part due to the downward biasing of the lowermost card in the stack preferentially at the end towards the feed roller. This angular difference seems to act as a valuable pre-separating feature as the cards travel down the input hopper in the stack towards the in-feed area of the machine. This is usually simplest achieved by making a portion of the hopper, either in one of the generally inclined portions or one of the vertical portions, slightly less than the dimension of the card so that the card has to tip or tilt a little as it passes through that section.

SPECIFIC DESCRIPTION OF PREFERRED EMBODIMENTS

The invention is further described by way of example only with reference to the accompanying drawings in which.

Figure 1:
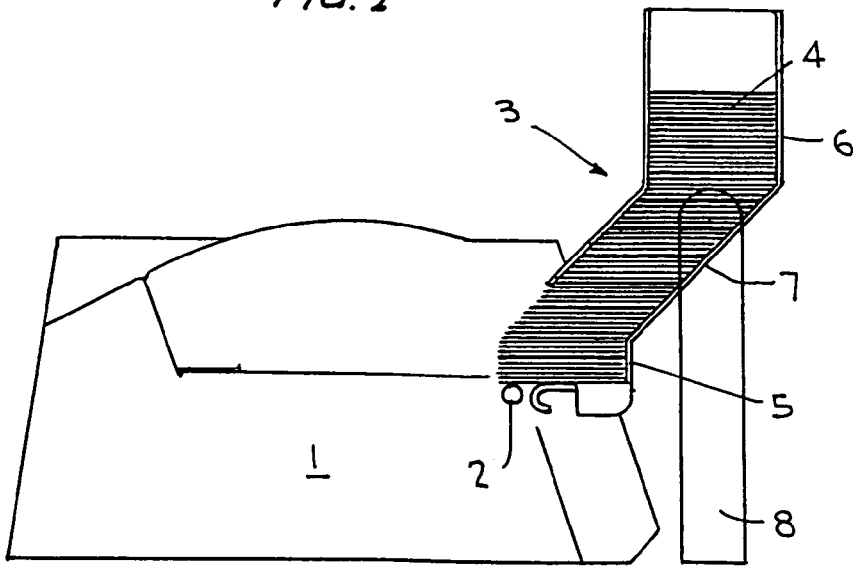
FIG. 1 shows a diagrammatic side view of a card printer device having an input hopper in accordance with the present invention.

Referring to FIG. 1, this shows in side view schematically a known card printer 1. This is drawn simply as the outline of the printer casing itself, the internal workings being unrelated to the present invention save for a driveable in-feed roller 2, the position of which is indicated diagrammatically to the right of the printer.

On the right hand side, the printer 1 carries a hopper 3 into which a stack of cards 4 has been inserted. This may be easily achieved by pivoting the hopper 3 around a pivot at its base sufficiently to enable the hopper front wall (to the left as shown in FIG. 1) to be swung upwards about a pivot at the top of the hopper, whereafter a stack of cards may be dropped into the hopper, the side wall swung down to enclose the stack and the entire hopper then pivoted back to the position shown in the drawing. When the printer is operated, cards from stack 4 are removed sequentially one by one from the base of the stack by intermittently driving in-feed roller 2 in the anti-clockwise direction as shown in FIG. 1. The surface of roller 2 is of a material which will frictionally engage adequately with the lower side of the lowermost card to slide it out from the base of the stack of cards. Following printing within the printer 1, the cards are ejected at the left hand end of the printer as shown in FIG. 1.

Normally, such a printer is supplied with a relatively small hopper which clips into the right hand side of the printer after it has been filled with cards. When all of the cards have been printed, the empty hopper is removed and either refilled with cards and replaced, or a separate pre-filled hopper is inserted. This manipulation is tiresome and the size of the hopper limits the maximum number of cards which can be printed in any one run. If the height of the hopper is extended to accommodate a taller stack of cards, the pressure at the base makes it difficult for the roller 2 to function reliably.

In accordance with the invention, hopper 3 includes a section which, when the hopper is placed in the right hand end of printer 1 as shown in FIG. 1 has a lower vertical section 5, an upper vertical section 6, and an intermediate section 7 which is then inclined to the vertical. As is clear from FIG. 1, the hopper 3 extends vertically above the remainder of printer 1, for example to a convenient height as shown in the drawing. The height could be slightly less or substantially more, depending upon the extent of upper vertical section 6.

Because the weight of the cards in a hopper of this increased capacity is substantial, a pillar 8 is provided pivotally attached to hopper 3 at its upper end and which extends downwardly to rest on the same surface as is supporting printer 1. The pillar may be swung anti-clockwise relative to the hopper to enable the hopper to be swung down for loading, as explained above. The degree of pivotal movement between pillar 8 and the hopper 3 is restricted, so that when the pillar is swung anti-clockwise relative to the hopper 3 to the maximum extent, it still supports hopper 3 while resting on the base on which printer 1 rests at an angle to the horizontal such that cards placed in the hopper tend to move towards its base and not its top.

The pillar 8 may incorporate means such as a screw-in foot to enable precise adjustment of the angle of the hopper to the printer 1. It may also be desirable to provide a base member to underlie both printer and pillar 8 including engagement means for the printer feet and the bottom of pillar 8 to define a preferred fixed relative position for these components.

Because of the presence of the angled section 7, the force between the lowermost card of the stack and the one immediately above it is reduced sufficiently for the in-feed roller 2 to operate satisfactorily without modification, enabling satisfactory sequential feeding of cards 4 from the bottom of the stack in hopper 3.

As shown in the drawing, the cards all lie horizontally in the stack. If the dimensions of the intermediate angled section 7 are adjusted so that the horizontal distance between the left and right hand walls of section 7 as shown in FIG. 1 is slightly less than the length of each card in stack 4, then as the cards gradually drop down the hopper as each card is removed from the base of the stack, they need to tip slightly lowering the left hand end of each card in the intermediate section relative to the right hand end of that card. Thus, as the stack of cards passes from vertical section 6 to the intermediate inclined section 7, they tend to be separated from one another and although they then travel down the inclined section as a set of cards each parallel to the next, when they move out of the bottom of angled section 7 into the lower vertical section 5, they are again subject to successive slight separation, this time at the right hand end of the cards as shown in FIG. 1. Thus, by the time they reach the bottom of the stack, each card has been separated from the cards lying above and below it twice. This automatic pre-separating feature is believed materially to entrance the reliability of single card feeding by roller 2.

Using the angled section in-feed hopper thus enables a much taller stack of cards to be processed using a standard printer without modifying the card take-off system of drive wheel 2 in any way.

As noted above, once they have been printed, cards exit the left hand end of printer 1 as shown in FIG. 1 through an appropriate exit chute. They can simply be allowed to form a loose pile, but this is inconvenient to handle and it is preferred to provide an outlet hopper at the left hand end of printer 1. Because the number of cards in a run is substantial, the eventual outlet stack would be as high as the stack of cards 4 in the hopper 3 before the printing run is started. In order to accommodate this, it is highly preferred to use an outlet hopper as diagrammatically indicated in FIG. 2.

Referring to that Figure, an outlet hopper or stacker 10 is located at the left hand end of printer 1. The stacker 10 consists of a generally vertical shaft 12 having located vertically slidable within it a movable floor unit 13. As shown, floor 13 has an upper inclined surface so that cards which emerge at regular intervals from a printer outlet 11 fall into the upwardly open top of shaft 12 and on to the floor 13 (in the case of the first card) and on to the stack of cards previously printed in the case of the remainder.

Figure 2:
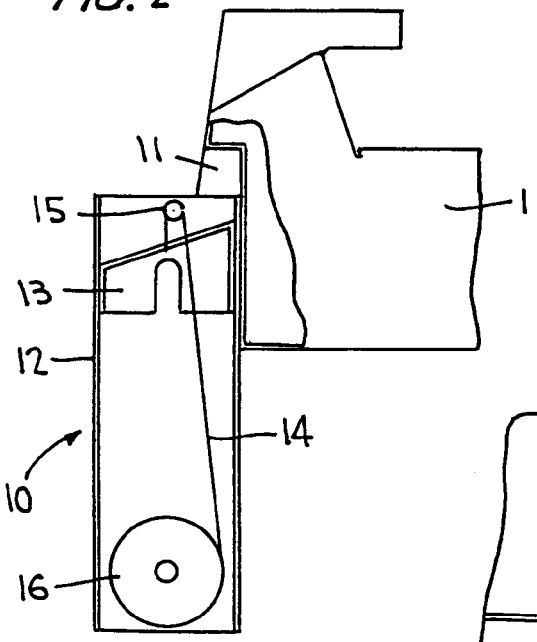
FIG. 2 is a schematic side view of the apparatus of the present invention showing a detail of a preferred outlet stack for the device.

Floor 13 is maintained when the stacker is empty at the position shown in FIG. 2 by means of a pair of suspension cords 14 which are attached to the floor 13 at each side and which run over small pulleys 15 located at the top of the shaft. The cords 14 extend downwardly at the sides of the shaft on to a spring-loaded drum 16 around which each cord 14 loops several times before being fixed to the drum. The spring loading of drum 16 is arranged to bias the drum clockwise as shown in FIG. 2 and with a biasing force sufficient to raise the movable floor 13 to the position shown. The biasing force, however, is relatively gentle so that, as cards emerge from printer outlet 11 and drop on to the floor and the stack of previous cards, the weight of the stack building up increases the combined weight of floor 13 and the cards themselves and this lowers the floor 13 down with a accompanying anti-clockwise rotation of drum 16.

Not shown in FIG. 2 is a vertical slot extending from the top of the shaft about three quarters of the way down in the left hand wall of shaft 12 as shown in FIG. 2. The left hand side of movable floor 13 as shown in FIG. 2 has a recess aligned with the slot in the wall of shaft 12 so that, when a stack of cards has built up, a finger may be inserted through the slot underneath the edge of the stack and the entire stack lifted out of the shaft 12 and taken away for further processing or despatch. As the cards are taken out, spring-loaded drum 16 lifts movable floor 13, now relieved of the weight of the stack, back to the position shown in FIG. 2.

As shown in FIG. 2, the shaft 12 extends downwardly from the body of printer 1. In order to accommodate this, printer 1 may be placed at the edge of a support surface such as a table or the like with the shaft 12 then extending downwardly below the surface of the table. Alternatively, printer 1 may be mounted on a suitable base unit which lifts it sufficiently high that the bottom of shaft 12 is above the surface on which the base unit rests.

Figure 3:
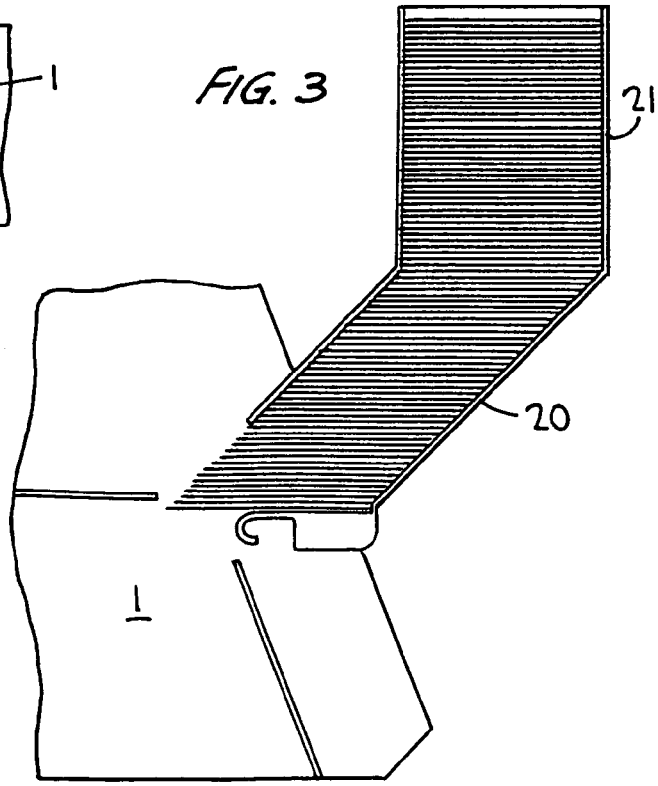
FIG. 3 is a diagrammatic side view showing an alternative input hopper design.

Turning now to FIG. 3, this shows diagrammatically an alternative form of input hopper. Instead of the zig-zag shape shown in FIG. 1, the hopper consists merely of a lower inclined section 20 inclined when the hopper is inserted into the printer 1 at about 45° to the vertical and an upper vertically extending section 21. Again, because of the inclined section, the force to shift the lowermost card to the left as shown in FIG. 3 can be supplied by the existing frictional drive roller located in the printer 1 even though the drive mechanism has been designed particularly in terms of the force it applies to produce only the force necessary to move the lowermost card In a relatively short vertical stack.

Figure 4:
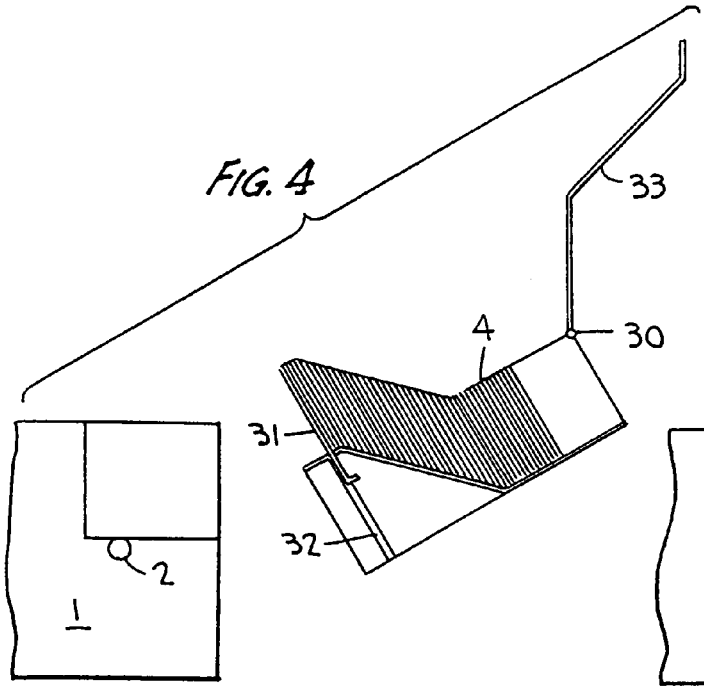
FIGS. 4 to 7 show diagrammatically the loading and placement on a printer of a further variant hopper design.
Figure 5:
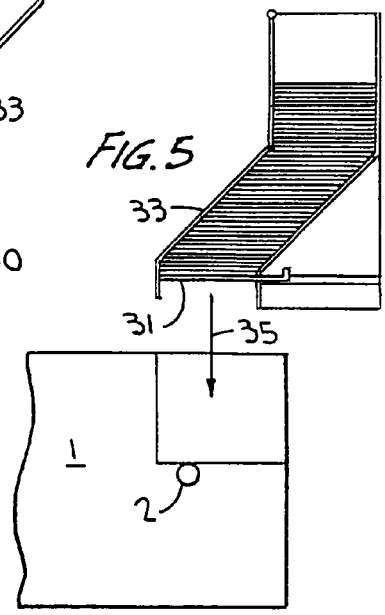

Referring now to FIGS. 4 to 7, this shows an alternative form of hopper of large capacity which is easier to load with cards. As can be seen, one side of the hopper is hinged about an axis 30 so enabling it to be swung up as shown in FIG. 4 so that cards 4 may be placed in it. A particular feature of the input hopper shown in FIGS. 4 to 7 is that the hopper contains a sliding shutter 31 running in tracks 32 formed in the sides of the hopper. When the cards 4 are loaded, slide 31 is in the position shown in FIG. 4 and, following loading, the hinged section of the hopper wall, denoted 33 in FIG. 4 is swung down to enclose the stack of cards 4 and the hopper then aligned as shown in FIG. 5. The hopper can then be moved downwards in the direction of arrow 35 shown in FIG. 5 so that the hopper adopts the position shown in FIG. 6. As can be seen, slider 31 now supports the stack of cards somewhat above the position of drive roller 2 in printer 1.

Figure 6:
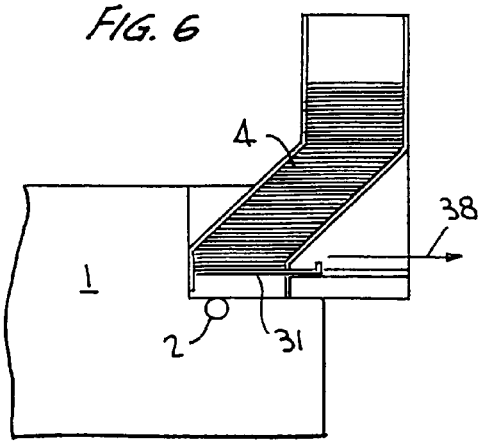
Figure 7:
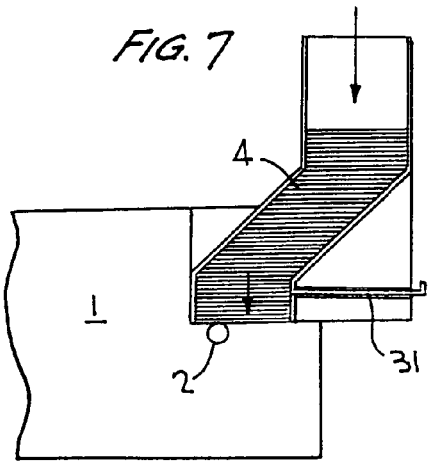

When it is desired to use the printer, slide 31 is pulled in the direction of arrow 38 shown in FIG. 6 and the cards in the stack 4 then move down the hopper as shown by the vertically downward-pointing arrows in FIG. 7. The lowermost card then comes into contact with the in-feed roller 2 and can be moved by rotating that roller to feed the lowermost card into the print station within printer 1. As in the case of the hopper shown in FIG. 1, the angled construction of the hopper means that secure feeding is obtained with the standard in-feed mechanism including drive roller 2 without modification to account for the taller stack and accordingly increase pressure on the lowermost card.

I claim:

1. In card printing apparatus having a printer unit, an input hopper for cards to be printed and an outlet for printed cards, wherein the input hopper, when placed in the card printer, surrounds a stack of cards, the lowermost card in the stack being horizontal, or substantially horizontal, the improvement comprising configuring the input hopper so that, when placed in the card printer, at least a section of the stack is inclined to the vertical by at least 10°, and wherein the input hopper comprises a lower and an upper section, both substantially vertical in use, and an inclined section intermediate the lower and upper sections.

2. In card printing apparatus having a printer unit, an input hopper for cards to be printed and an outlet for printed cards, wherein the input hopper, when placed in the card printer, surrounds a stack of cards, the lowermost card in the stack being horizontal, or substantially horizontal, the improvement comprising configuring the input hopper so that, when placed in the card printer, at least a section of the stack is inclined to the vertical by at least 10°; and including a substantial vertically extending output hopper comprising a card-receiving shaft and a stacking floor adapted to move downwardly as the weight of cards stacked thereon increases.

3. The card printing apparatus of claim 2 wherein the output hopper has a floor slidable in a shaft, the floor being suspended via cords, the tension in the cords being regulated by a spring-loaded drum around which the cords loop.

4. In card printing apparatus having a printer unit, an input hopper for cards to be printed and an outlet for printed cards, wherein the input hopper, when placed in the card printer, surrounds a stack of cards, the lowermost card in the stack being horizontal, or substantially horizontal, the improvement comprising configuring the input hopper so that, when placed in the card printer, at least a section of the stack is inclined to the vertical by from 15° to 45°, and the input hopper comprises a lower section and an upper section, both substantially vertical in use, and an inclined section intermediate the lower section and the upper section.

* * * * *